US007140582B1

(12) United States Patent
Miller et al.

(10) Patent No.: US 7,140,582 B1
(45) Date of Patent: Nov. 28, 2006

(54) QUICK CONNECT LADDER CLAMP

(76) Inventors: Ronald Miller, 10011 Montelago La., Culpeper, VA (US) 22701; Charles K. Miller, 16046 Glen Ella Rd., Culpeper, VA (US) 22701; Jason L. Williams, 3515 Melrose Ave., Erie, PA (US) 16508

( * ) Notice: Subject to any disclaimer, the term of this patent is extended or adjusted under 35 U.S.C. 154(b) by 0 days.

(21) Appl. No.: 10/979,537

(22) Filed: Nov. 1, 2004

(51) Int. Cl.
*A47B 96/00* (2006.01)
*B25B 1/00* (2006.01)

(52) U.S. Cl. ..... 248/231.41; 248/229.22; 269/6; 269/166

(58) Field of Classification Search ..... 248/230.1, 248/230.3, 230.5, 230.6, 231.61, 231.71, 248/237, 210, 689, 229.1, 229.2, 226.21, 248/231.41; 269/6, 166, 170, 168, 169
See application file for complete search history.

(56) References Cited

U.S. PATENT DOCUMENTS

| | | | | |
|---|---|---|---|---|
| 4,926,722 | A * | 5/1990 | Sorensen et al. | 81/487 |
| 5,222,420 | A * | 6/1993 | Sorensen et al. | 81/487 |
| 5,833,359 | A * | 11/1998 | Hollenbach | 362/250 |
| 6,367,787 | B1 * | 4/2002 | Poole et al. | 269/6 |
| 6,474,632 | B1 * | 11/2002 | Liou | 269/6 |
| 6,648,315 | B1 * | 11/2003 | Lee | 269/6 |
| 6,676,120 | B1 * | 1/2004 | Hallbeck et al. | 269/6 |

* cited by examiner

*Primary Examiner*—Carl D. Friedman
*Assistant Examiner*—Tan Le
(74) *Attorney, Agent, or Firm*—Richard K. Thomson

(57) ABSTRACT

First and second C-shaped clamping members are provided to engage a ladder and a roof rack. One of the clamping members is mounted on an actuator rod, the other on an actuator housing. A pistol grip handle and trigger mechanism enable the two clamping members to be ratcheted into secure clamping engagement with the two items. A quick release plate allows the clamp to be easily opened for disengagement. In a second embodiment, a compression spring draws the two clamping members together when the quick release plate is engaged.

8 Claims, 5 Drawing Sheets

QUICK CONNECT LADDER CLAMP

BACKGROUND AND SUMMARY OF THE INVENTION

The present invention is directed to the field of attachment. More particularly, the present invention is directed to a quick connect clamp which permits a ladder to be securely fastened to a rack, such as a vehicle roof rack.

Carpenters, painters, roofers, and do-it-yourselfers struggle to secure a ladder to a vehicle. Any variety of ropes, bungee cords, and assorted other devices are used in an attempt to securely fasten a ladder to the roof or side of a vehicle. These devices are time consuming to put on and take off and frequently fail to hold the ladder securely, risking damage to the ladder, the vehicle to which it is insecurely attached and to other traffic (pedestrian and vehicular) which may be unfortunate enough to be in the way when these devices let loose. What is needed is a clamp which can be quickly connected and released and, which holds securely while it is engaged.

The quick connect ladder clamp of the present invention fills this need. This clamp comprises a first clamp member for engaging a portion of the roof rack; a second clamp member for engaging a portion of the ladder; an actuator rod attached to one of the first and second clamp members; an actuation housing attached to another of the first and second clamp members; means to move the actuator rod within the actuation housing; means to lock the actuator rod in a fixed position relative to the actuation housing; quick release means to permit the first and second clamp members to release their grip on the roof rack and the ladder. Preferably, the actuator rod is non-circular in cross section, most preferably, oval with a row of teeth formed on at least one edge thereof.

The actuation housing has a pistol grip handle attached thereto and the first and second clamp members extend laterally from the actuator housing generally orthogonal to the pistol grip handle. In the preferred embodiment, the first and second clamp members are C-shaped. A trigger mechanism has a portion thereof extending into said actuator housing engaging a face of a washer, the opposite face being in contact with a coil spring. The quick release means comprises a plate with an oval recess which receives the oval actuator rod, the plate being pivotally engaged by an overhanging lip on a front portion of the actuator housing and biased into a canted position by a spring, whereby a portion of the oval recess engages the teeth on the oval rod and retains the actuator housing in locked position relative to the actuator rod. In a second embodiment, the means to move the actuator rod in the actuation housing further comprises a coil spring.

Various other features, advantages and characteristics of the present invention will become apparent to one of ordinary skill in the art after a reading of the following specification.

BRIEF DESCRIPTION OF THE DRAWINGS

The preferred embodiment(s) of the present invention is/are described in conjunction with the associated drawings in which like features are indicated with like reference numerals and in which.

DETAILED DESCRIPTION OF PREFERRED EMBODIMENT(S)

Figure 1:
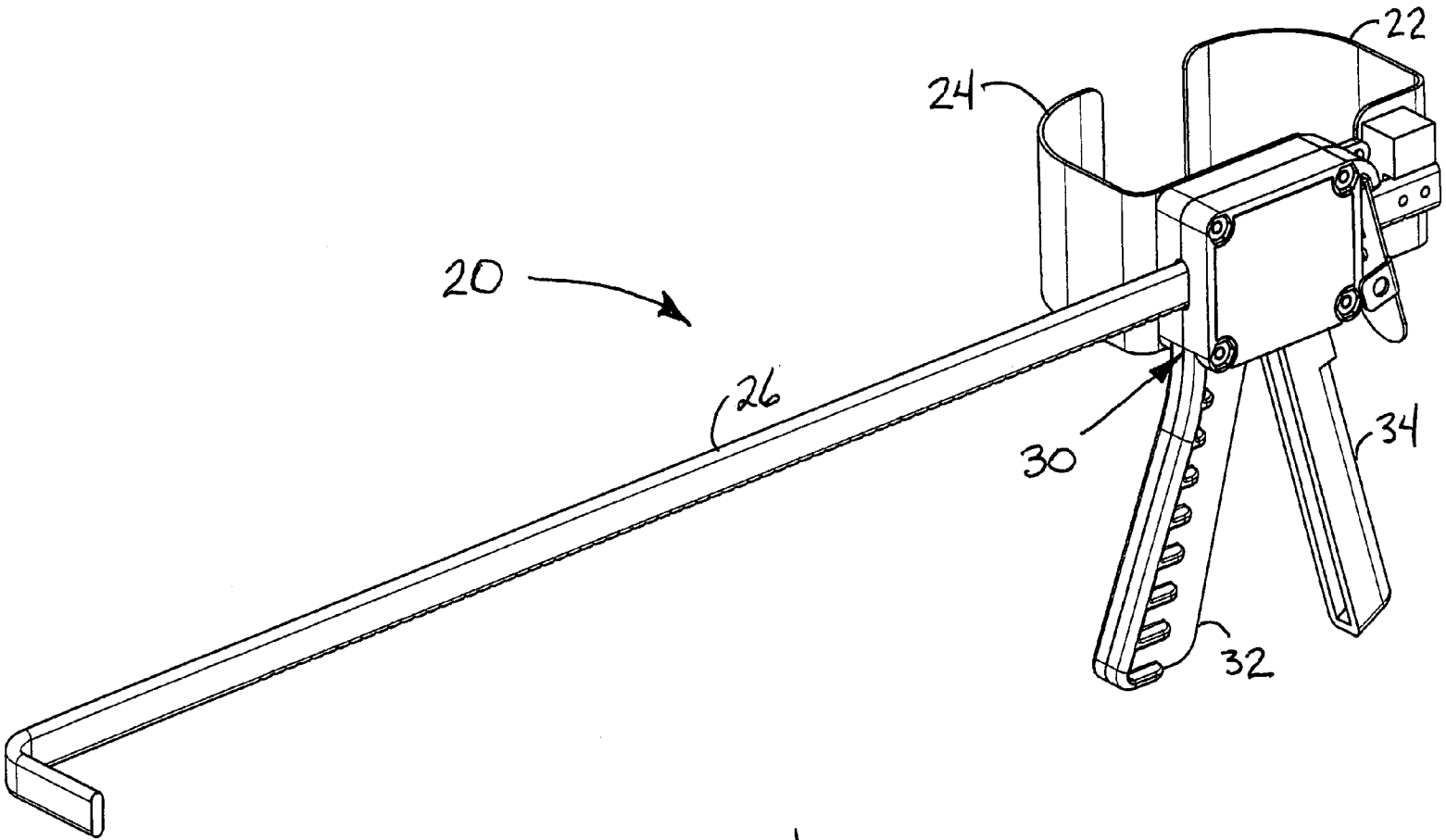
FIG. 1 is a perspective view of a first embodiment of the quick connect ladder clamp of the present invention.
Figure 2:
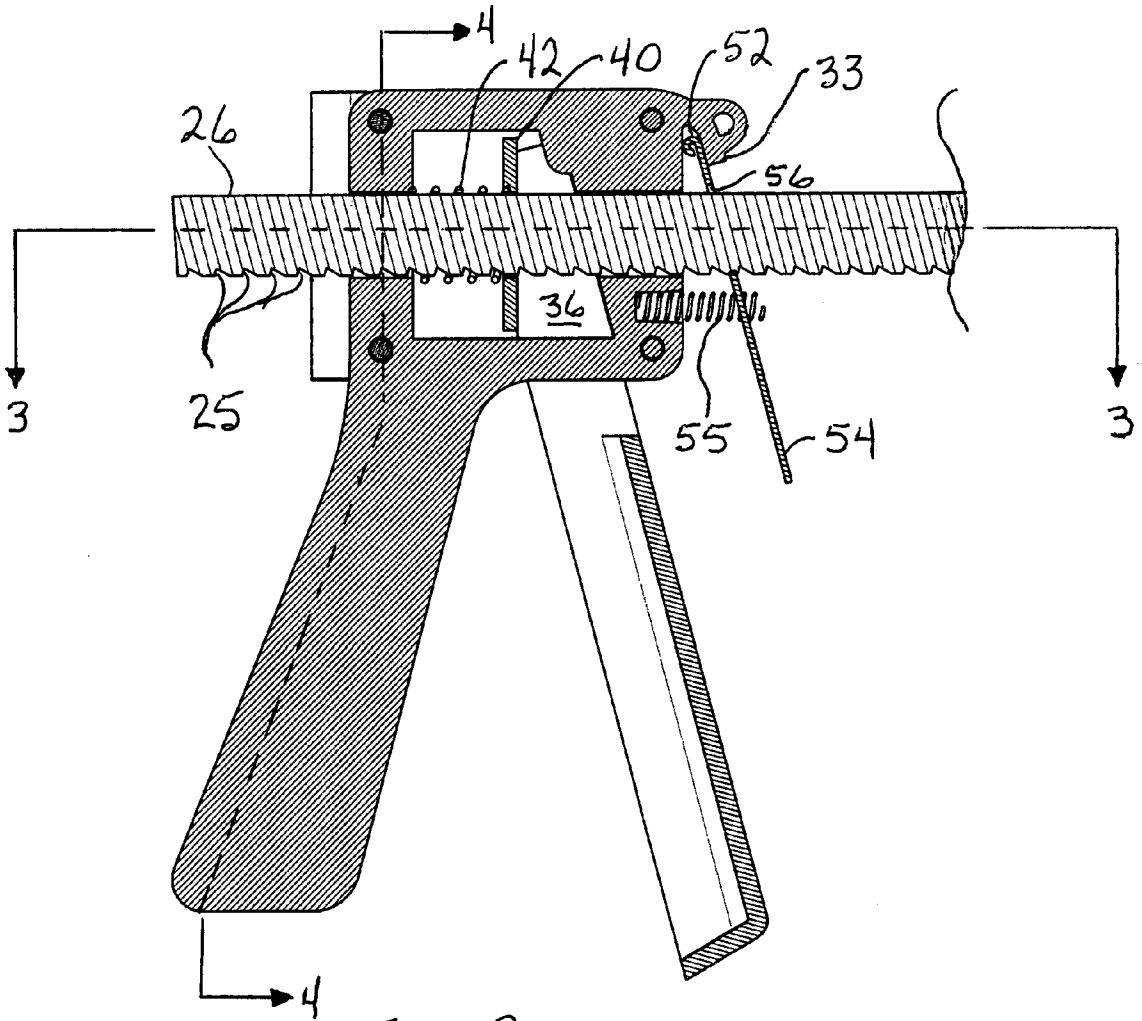
FIG. 2 is a cross-sectional side view of a first embodiment taken through the actuator housing.
Figure 3:
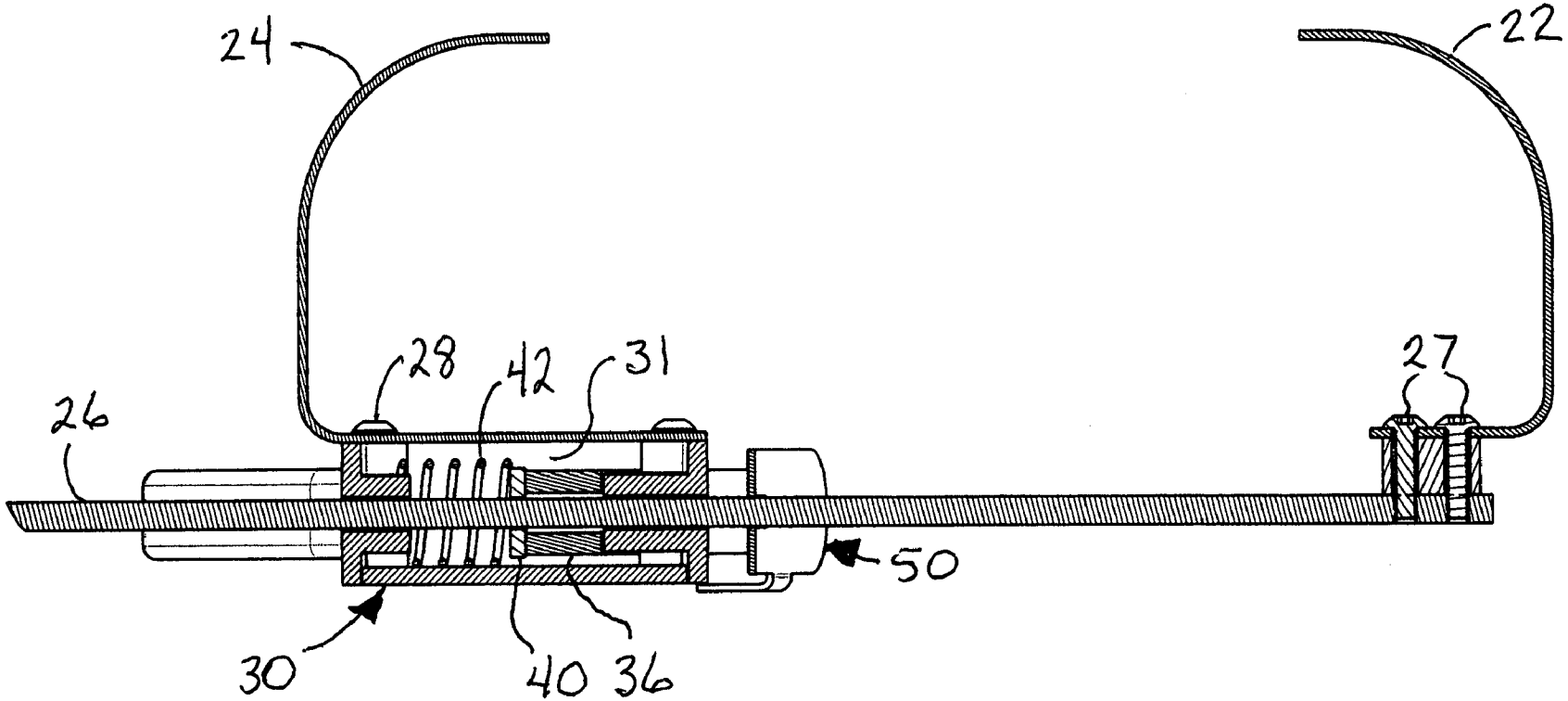
FIG. 3 is a cross-sectional top view as seen along line 3—3 in FIG. 2.
Figure 4:
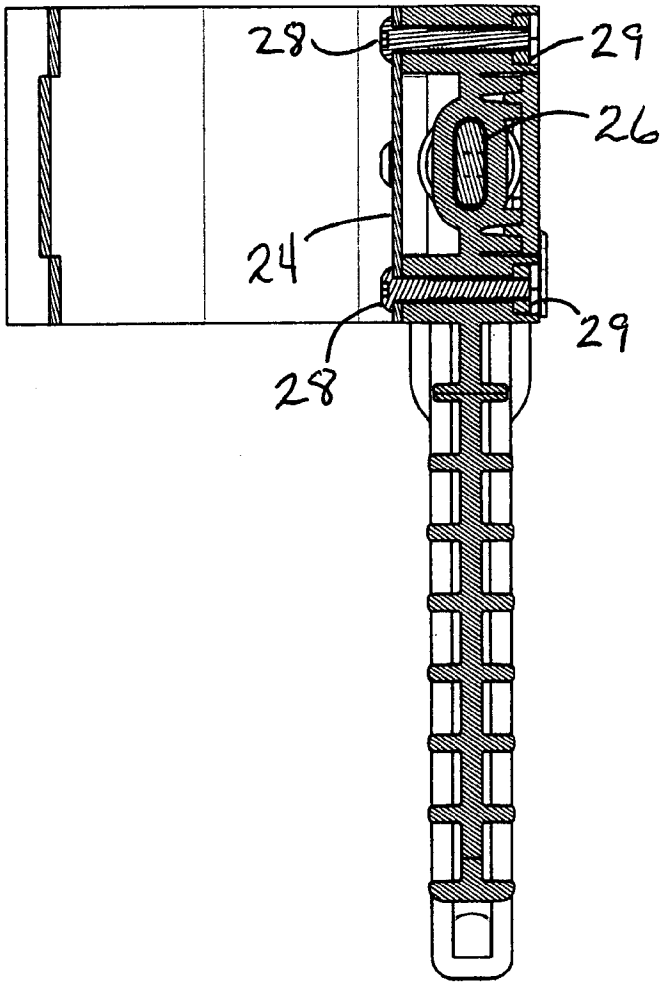
FIG. 4 is a cross-sectional end view as seen along line 4—4 in FIG. 3.

A first embodiment of the quick connect ladder clamp of the present invention is depicted in FIGS. 1–4 generally at 20. Ladder clamp 20 includes a first clamp member 22 and a second clamp member 24. The clamp members 22, 24 are preferably C-shaped and a first one of the clamp members 22, 24 is attached to actuator rod 26 by screws 27 (FIG. 3) and the other of the clamp members 22, 24 is attached to actuator housing 30 by bolt/nut pairs 28, 29 (FIG. 4). Actuator rod 26 is preferably oval, or "pill shaped" with ratchet teeth 25 on the lower edge thereof. Actuator housing 30 includes pistol grip handle 32 and trigger mechanism 34. An upper portion 36 of trigger mechanism 34 extends into an internal chamber 31 of actuator housing 30 and engages washer element 40.

A quick release plate 50 has a first end 52 captured under an overhanging lip 33 of actuator housing 30. Quick release plate 50 has an oval hole 56 that receives actuator rod 26 and, when generally vertically oriented, permits rod 26 to slide there through. Second end 54 is biased outwardly away from housing 30 by spring 55 so that plate 50 assumed a canted position in which the lower edge of oval hole 56 engages ratchet teeth 25. As the trigger mechanism 34 is compressed toward handle 32, canted washer element 40 engages ratchet teeth 25 locking on actuator rod 26 moving the washer element 40 and rod 26 toward handle 32 against the bias of spring 42. The sloped surfaces on teeth 25 permit rod 26 to slide through oval hole 56 in plate 50 as it moves toward the handle 32 (FIG. 2) while inhibiting movement away therefrom.

In use, depressing quick release means 50 permits the actuator rod 26 to slide uninhibited through housing 30, to open clamp members 22, 24 to a distance sufficient to accommodate a ladder portion, say a leg (not shown), and a car roof rack. At this point, with the release means 50 still depressed, the clamp members 22, 24 can be moved into proximate engagement of the ladder leg and the roof rack. Then by repetitively compressing trigger mechanism 34, the clamp members 22, 24 are ratcheted into a secure gripping engagement of the secured members.

Figure 5:
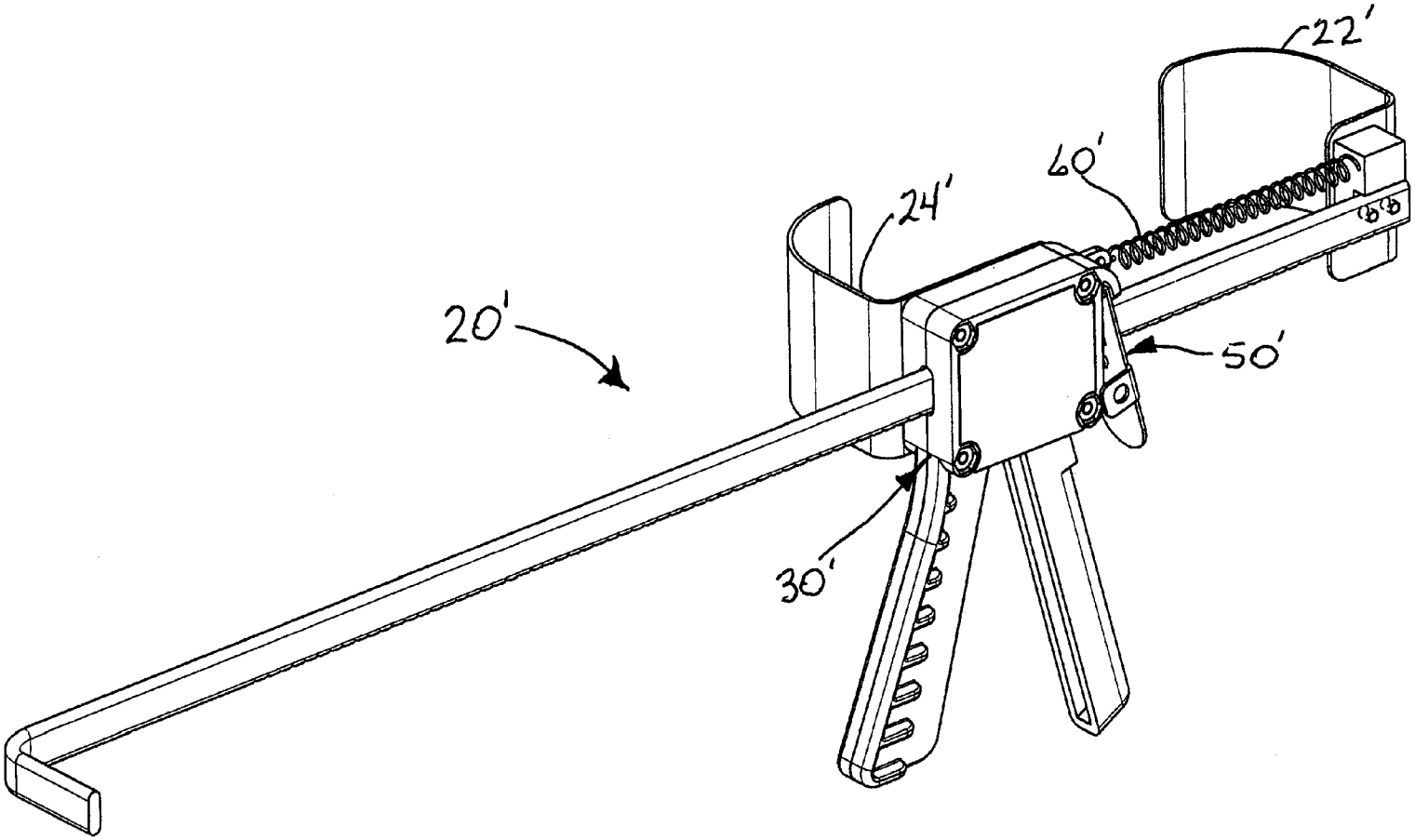
FIG. 5 is a perspective view of a second embodiment of the quick connect ladder clamp of the present invention.

A second embodiment of the quick connect ladder clamp of the present invention is depicted in FIG. 5 generally at 20'. Second embodiment of ladder clamp 20' performs in all ways like the first with the exception that compression spring 60' extending between housing 30' and clamp element 22' means when quick release plate 50' is engaged, the initial positioning of clamp members 22', 24' into proximate engagement with the elements to be clamped together will occur without the need of additional manipulation as the spring draws clamp members 22', 24' toward each other.

Various changes, alternatives and modifications will become apparent to one of ordinary skill in the art following a reading of the foregoing specification. It is intended that any such changes, alternatives and modifications as fall within the scope of the appended claims be considered part of the present invention.

I claim:

1. A clamp for securing a ladder to a roof rack of a vehicle comprising a) a first C-shaped clamp member for partially surrounding and engaging a portion of the roof rack;

b) a second C-shaped clamp member for partially surrounding and engaging a portion of the ladder;

c) an actuator rod attached to one of said first and second clamp members;

d) an actuation housing attached to another of said first and second clamp members, a pistol grip handle attached to said actuation housing and extending from a bottom side thereof, said first and second C-shaped clamp members extending laterally from a first lateral side of said actuation housing generally orthogonally to said pistol grip handle;

e) means to move said actuator rod within said actuation housing;

f) means to lock said actuator rod in a fixed position relative to said actuation housing;

g) quick release means to permit said first and second clamp members to release their grip on the roof rack and the ladder;

whereby when said first and second C-shaped clamp members are moved by said means to actuator rod to positions partially surrounding and engaging the portion of the roof rack and the portion of the ladder, respectively, and secured in those positions by said means to lock said actuator rod in a fixed position, the ladder is retained on the vehicle.

2. The clamp of claim 1 wherein said actuator rod is non-circular in cross section.

3. The clamp of claim 2 wherein said actuator rod is oval in cross section.

4. The clamp of claim 3 wherein said actuator rod has a row of teeth formed on at least one edge thereof.

5. The clamp of claim 4 said pistol grip handle further comprising a trigger mechanism having a portion thereof extending into said actuation housing engaging a face of a washer, said opposite face being in contact with a coil spring.

6. The clamp of claim 5 wherein said quick release means comprises a plate with an oval recess which receives said oval actuator rod, said plate being pivotally engaged by an overhanging lip on a front portion of said actuation housing and biased into a canted position by a spring, whereby a portion of said oval recess engages said teeth on said oval rod and retains said actuation housing in locked position relative to said actuator rod.

7. The clamp of claim 5 wherein said means to move said actuator rod in said actuation housing further comprises a coil spring.

8. A clamp for securing a ladder to a roof rack of a vehicle comprising a) a first C-shaped clamp member for partially surrounding and engaging a portion of the roof rack;

b) a second C-shaped clamp member for partially surrounding and engaging a portion of the ladder;

c) an actuator rod having an oval cross section, a row of teeth formed on at least one edge thereof, and being attached to one of said first and second clamp members;

d) an actuation housing attached to another of said first and second clamp members, said actuator housing having a pistol grip handle extending from a bottom side thereof and a trigger mechanism having a portion thereof extending into said actuation housing engaging a face of a washer, said opposite face being in contact with a coil spring said first and second C-shaped clamp members extending laterally therefrom orthogonal to said pistol grip;

e) means to move said actuator rod within said actuation housing;

f) means to lock said actuator rod in a fixed position relative to said actuation housing;

g) quick release means to permit said first and second clamp members to release their grip on the roof rack and the ladder, said quick release means comprising a plate with an oval recess which receives said oval actuator rod, said plate being pivotally engaged by an overhanging lip on a front portion of said actuation housing and biased into a canted position by a spring, whereby a portion of said oval recess engages said teeth on said oval rod and retains said actuation housing in locked position relative to said actuator rod;

whereby when said first and second C-shaped clamp members are moved by said means to actuator rod to positions partially surrounding and engaging the portion of the roof rack and the portion of the ladder, respectively, and secured in those positions by said means to lock said actuator rod in a fixed position, the ladder is retained on the vehicle.

* * * * *